US011167965B2

(12) United States Patent
Turnbull et al.

(10) Patent No.: US 11,167,965 B2
(45) Date of Patent: Nov. 9, 2021

(54) TRUCK MOUNTED FORKLIFT

(71) Applicant: Cargotec Research & Development Ireland Limited, Dundalk (IE)

(72) Inventors: Kevin Turnbull, Knockbridge (IE); Sarah Grogan, Swords (IE)

(73) Assignee: CARGOTEC RESEARCH & DEVELOPMENT IRELAND LIMITED, Dundalk (IE)

( * ) Notice: Subject to any disclaimer, the term of this patent is extended or adjusted under 35 U.S.C. 154(b) by 0 days.

(21) Appl. No.: 15/768,434

(22) PCT Filed: Oct. 14, 2016

(86) PCT No.: PCT/EP2016/074821
§ 371 (c)(1),
(2) Date: Apr. 13, 2018

(87) PCT Pub. No.: WO2017/064313
PCT Pub. Date: Apr. 20, 2017

(65) Prior Publication Data

US 2018/0319639 A1 Nov. 8, 2018

(30) Foreign Application Priority Data

Oct. 14, 2015 (GB) ..... 1518206

(51) Int. Cl.
*B66F 9/065* (2006.01)
*B66F 9/075* (2006.01)

(52) U.S. Cl.
CPC ..... *B66F 9/065* (2013.01); *B66F 9/07563* (2013.01)

(58) Field of Classification Search
CPC .... B66F 9/07563; B66F 9/065; B66F 9/0655; B66F 9/06; B66F 9/12; B66F 9/14; B66F 9/141

(Continued)

(56) References Cited

U.S. PATENT DOCUMENTS 3,001,654 A * 9/1961 Albert ..... B66F 9/065 414/707
3,606,060 A * 9/1971 Fleming et al. ..... B66F 9/065 414/708

(Continued)

FOREIGN PATENT DOCUMENTS

GB 1330245 9/1973

OTHER PUBLICATIONS

International Search Report issued in PCT Application Serial No. PCT/EP2016/074821 dated Feb. 2, 2017.

*Primary Examiner* — Glenn F Myers
(74) *Attorney, Agent, or Firm* — Brian J. Colendreo; Jeffrey T. Placker; Holland & Knight LLP

(57) ABSTRACT

This invention relates to a truck mounted forklift for mounting on the rear of a carrying vehicle, the truck mounted forklift having a lifting assembly mounted on the chassis, the lifting assembly comprising a linkage, the linkage comprising: an elongate first link connected at its proximal end to the chassis by a pivot joint; an elongate second link connected at its proximal end to the distal end of the first link by a pivot joint; a fork carriage connected to the distal end of the second link by a pivot joint; a plurality of link cylinders for actuating the links; and a tilt cylinder for actuating the fork carriage. By having such a truck mounted forklift, top far side loads will be accessible without the lifting assembly coming into contact with the roof of the carrying vehicle or with bottom near side loads. Additionally, the front wheels of the truck mounted forklift will not need to be positioned under the carrying vehicle to reach top far side loads. This will minimise the time needed to load and unload carrying vehicles.

20 Claims, 10 Drawing Sheets

(58) Field of Classification Search
USPC ..... 414/477, 685, 697
See application file for complete search history.

(56) References Cited

U.S. PATENT DOCUMENTS

| | | | | |
|---|---|---|---|---|
| 4,826,474 | A | 5/1989 | Holmes | |
| 4,925,358 | A * | 5/1990 | Cook | E02F 5/00 414/685 |
| 5,584,643 | A * | 12/1996 | Nishimura | E02F 3/301 414/685 |
| 5,813,821 | A * | 9/1998 | Braud | B66F 9/07563 414/664 |
| 6,641,355 | B1 * | 11/2003 | McInerney | B66F 9/0655 180/211 |
| 2005/0220588 | A1 | 10/2005 | Turnbull et al. | |

* cited by examiner

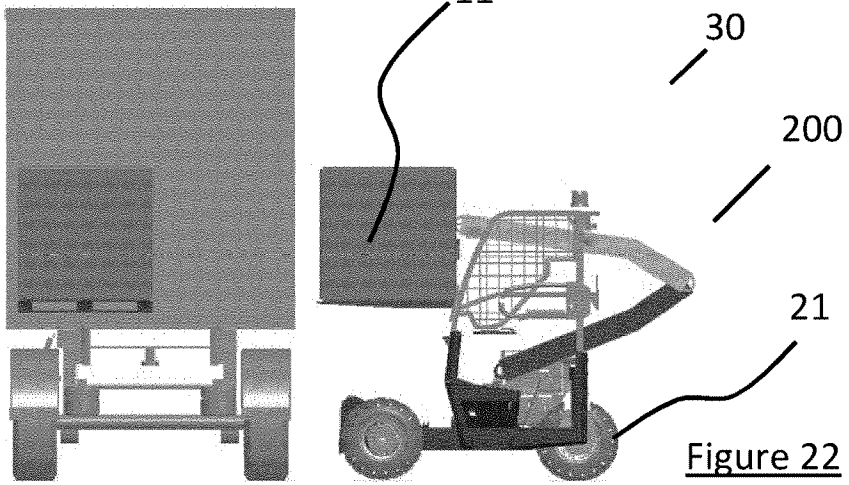
Figure 22
Figure 21
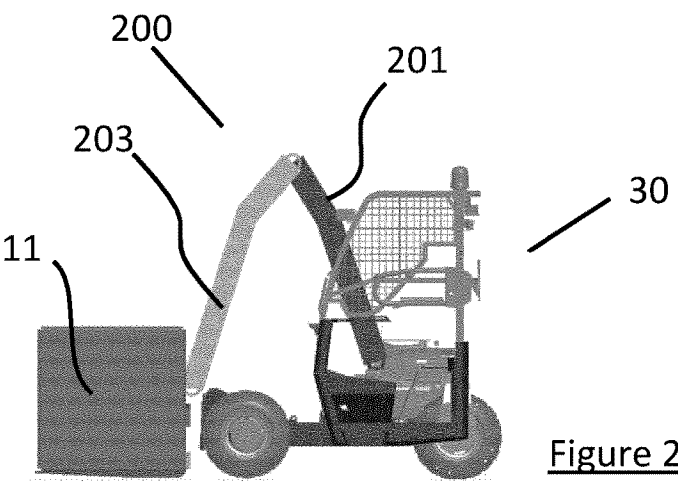
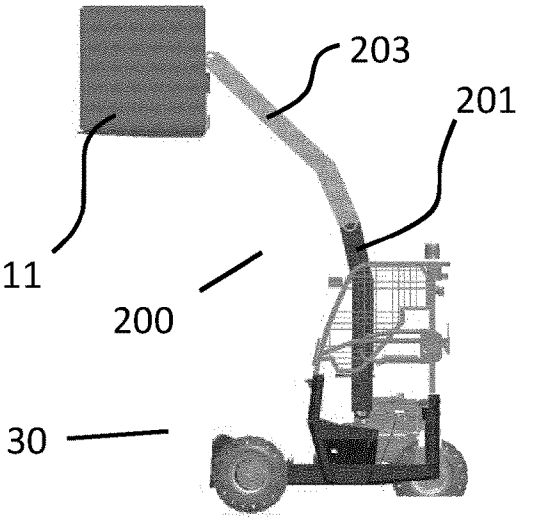
Figure 24
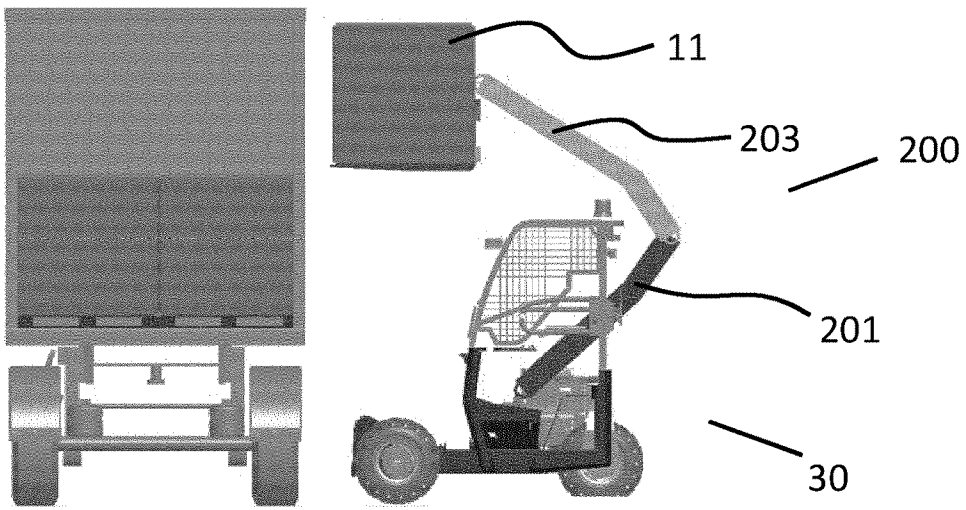
Figure 23

TRUCK MOUNTED FORKLIFT

CROSS-REFERENCE TO RELATED APPLICATIONS

This application is a U.S. National Stage of International Patent Application No. PCT/EP2016/074821, filed 14 Oct. 2016, which claims priority to Great Britain Patent Application No: 1518206.6, filed on 14 Oct. 2015, the disclosure of which is incorporated herein by reference in its entirety.

TECHNICAL FIELD

This invention relates to a truck mounted forklift. More specifically, this invention relates to a truck mounted forklift with an alternative lifting assembly.

BACKGROUND ART

Truck mounted forklifts are a highly specialised type of lightweight forklift truck that can be mounted on the rear of a truck or trailer for transport to and from customer's premises. Once at the customer's premises, the truck mounted forklift can be dismounted from the rear of the truck and used to load and unload goods from the truck or trailer before being remounted onto the rear of the truck or trailer for transport to the next customer's premises.

Out of necessity, the truck mounted forklifts must be lightweight as any increase in truck mounted forklift weight will correspond to a decrease in available haulage capacity of the truck or trailer about which it is mounted. Furthermore, the truck mounted forklifts must be compact in a fore and aft sense as the amount by which the truck mounted forklift may protrude from the rear of the carrying vehicle (commonly referred to as "overhang") is restricted by law in many jurisdictions. Furthermore, the greater the overhang, the greater the forces applied to the mounting. Increased forces necessitate reinforcement of these components which typically leads to increased weight which as described before is highly undesirable. An example of one such truck mounted forklift is that disclosed in the Applicant's own granted European Patent No. EP1711428. The present invention is concerned solely with this type of specialised lightweight forklift truck and is to be considered in light of the limitations of truck mounted forklifts. The present invention is in no way intended to relate to other types of forklift trucks such as the commonplace heavyweight counterbalanced forklift trucks that are not so restricted and do not require the same design considerations.

Heretofore, some of the most common lifting assembly configurations used in truck mounted forklifts have been moving mast, static mast and telescopic boom configurations. The moving mast and static mast implementations typically comprise a pantograph linkage or other mechanism to increase the reach of the forks carried on the mast. While each of these configurations has advantages, each also has a distinct problem with loading and unloading the top far side of a container or trailer. Due to the height of the pantograph arrangement, moving masts with pantograph sections cannot reach under the top of containers or trailers. Static mast machines can only reach the far side of a trailer if they can drive the front wheels under the truck or trailer which is not always possible. Furthermore, static mast machines equipped with a pantograph arrangement may also be prevented from reaching under the top of the trailer or container. Telescopic booms are obstructed by bottom near side loads when reaching top far side loads and the bottom near side loads must be moved prior to the top far side loads being accessed. In addition to the inconvenience, this can also make the trailer unstable as all the loads are on one side.

It is an object therefore of the present invention to provide a truck mounted forklift that overcomes at least some of the above-mentioned problems and that provides a useful choice for the consumer.

SUMMARY OF INVENTION

According to the invention there is provided a truck mounted forklift for mounting on the rear of a vehicle, the truck mounted forklift comprising a u-shaped chassis having a pair of forwardly projecting side bars bridged by a rear crossbar, a wheel adjacent the forwardmost end of each of the side bars and a rear wheel mounted on the rear cross bar, a driver's station mounted to one side of the chassis, a motive power unit mounted on the other side of the chassis and a lifting assembly mounted on the chassis, characterised in that, the lifting assembly comprises a linkage, the linkage comprising:

- an elongate first link connected at its proximal end to the chassis by a pivot joint;
- an elongate second link connected at its proximal end to the distal end of the first link by a pivot joint;
- a fork carriage connected to the distal end of the second link by a pivot joint;
- a plurality of link cylinders for actuating the links; and
- a tilt cylinder for actuating the fork carriage.

By having such a truck mounted forklift, the forklift truck will not be inhibited by the limitations of the known lifting assemblies. In particular, the forklift truck will be able to reach top far side loads without coming into contact with the roof of the trailer; will not have to drive its front wheels under the trailer and will not interfere with lower near side loads when attempting to engage top far side loads.

In one embodiment of the invention there is provided a truck mounted forklift comprising an elongate third link connected intermediate the first and second links, in which instead of the proximal end of the second link being connected to the distal end of the first link by a pivot joint, one end of the third link is connected to the distal end of the first link by a pivot joint, and the other end of the third link is connected to the proximal end of the second link by a pivot joint. This is seen as a particularly useful configuration of lifting assembly. By incorporating a third linkage, the lifting assembly will not interfere with the rear steering set-up at any stage during its movement. In addition, a lower collapsed height is achieved with the addition of a third link. It is envisaged that the range of motion of the forks will be improved by incorporating a third linkage.

In one embodiment of the invention there is provided a truck mounted forklift in which one of the link cylinders, a main lift cylinder, is connected to the chassis at one of its ends and connected to the first link at the other of its ends.

In one embodiment of the invention there is provided a truck mounted forklift in which the tilt cylinder is connected at one of its ends to the fork carriage and at the other of its ends to the second link.

In one embodiment of the invention there is provided a truck mounted forklift in which each pair of adjacent connected links is further coupled together by one of the link cylinders.

In one embodiment of the invention there is provided a truck mounted forklift in which there is provided a control system operable to synchronise the operation of the tilt and link cylinders. This allows the driver to securely move loads in a variety of directions including horizontal or vertical directions by synchronizing the operation of the link cylinders. Furthermore, the control system operable to synchronise the operation of the tilt and link cylinders will provide a smoother motion of the lifting assembly and will self-level the load by controlling the tilt cylinder, thereby speeding up the loading and unloading of goods.

In one embodiment of the invention there is provided a truck mounted forklift whereby the linkage is configured to not extend rearwards beyond the rear wheel of the chassis when fully retracted. This results in the truck mounted forklift having no more overhang than previous models.

In one embodiment of the invention there is provided a truck mounted forklift in which the linkage is configured to prevent the second link from pivoting rearwardly beyond a substantially vertical orientation with respect to the ground. This is particularly advantageous as this configuration will ensure that the lifting assembly will not interfere with a load mounted on the fork carriage.

In one embodiment of the invention there is provided a truck mounted forklift whereby the lifting assembly further comprises a carriage slidably mountable on the chassis, the carriage being slidable towards and away from the rear crossbar and means to move the carriage back and forth along the chassis, and in which the proximal end of the first link is mounted on the carriage. This implementation extends the possible reach of the forks.

In one embodiment of the invention there is provided a truck mounted forklift in which the first link is cranked intermediate its ends. It is envisaged that the second link may be cranked intermediate its ends. It is further envisaged that the third link may be cranked intermediate it's ends.

In one embodiment of the invention there is provided a truck mounted forklift in which there is provided a third link, and in which the third link is shorter in length than the first link. In one embodiment of the invention, the third link is shorter in length than the second link.

In one embodiment of the invention there is provided a truck mounted forklift in which the lifting assembly is mounted centrally across the truck mounted forklift substantially in line with the longitudinal axis of the truck mounted forklift.

BRIEF DESCRIPTION OF THE DRAWINGS

The invention will now be more clearly understood from the following description of some embodiments thereof given by way of example only with reference to the accompanying drawings, in which:

FIGS. 17 to 26 inclusive are side views of an alternative embodiment of a truck mounted forklift according to the invention.

DETAILED DESCRIPTION OF THE DRAWINGS

Figure 1:
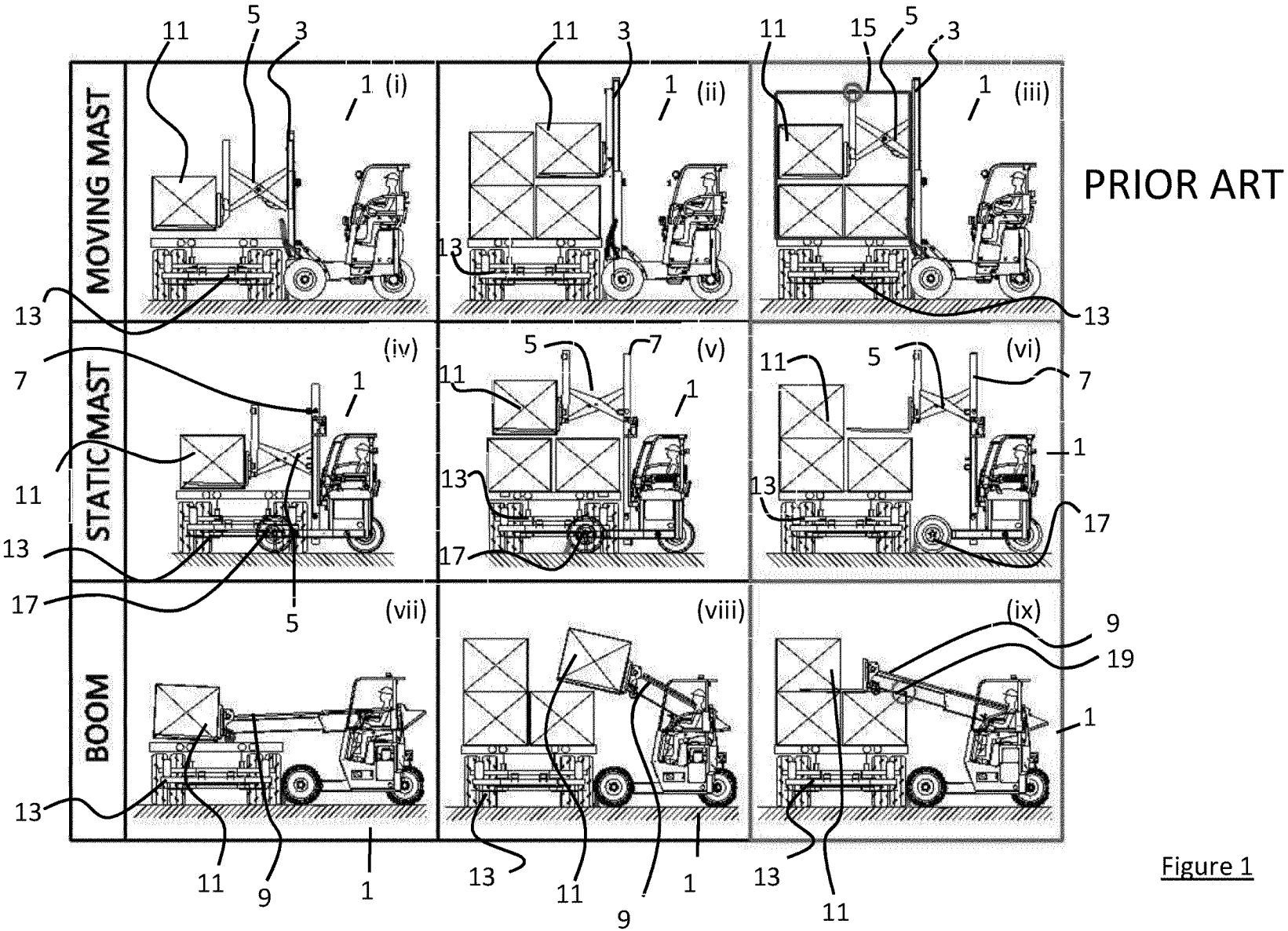
FIGS. 1 (*i*) to (*ix*) illustrate truck mounted forklifts with lifting assemblies known in the art.

Referring to FIGS. 1(*i*) to 1(*ix*) inclusive, there are shown views of truck mounted forklifts with known lifting assemblies. FIGS. 1(*i*) to 1(*iii*) illustrate a truck mounted forklift 1 with a movable mast 3 having a pantograph linkage 5. FIGS. 1(*iv*) to 1(*vi*) illustrate a truck mounted forklift 1 with a static mast 7 having a pantograph linkage 5. FIGS. 1(*vii*) to 1(*ix*) illustrate a truck mounted forklift with a telescopic boom 9.

Referring specifically to FIGS. 1(*i*) to 1(*iii*), the truck mounted forklift with a movable mast is illustrated engaging a load 11 in a variety of positions on a carrying vehicle 13. In FIG. 1(*i*) the truck mounted forklift 1 is shown engaging a load 11 located in the bottom far side position of the carrying vehicle. The movable mast 3 is positioned forwards on the forklift 1 and the pantograph linkage 5 is fully extended. In FIG. 1(*ii*) the truck mounted forklift 1 is shown engaging a load 11 located in the top near side position of the carrying vehicle. It can be seen that there are no impediments to the lifting assembly engaging loads in these positions. In FIG. 1(*iii*) the truck mounted forklift 1 is shown attempting to engage a load in the top far side position on the carrying vehicle. It can be seen that the pantograph linkage comes into contact with the underside of the roof 15 of the carrying vehicle 13. Accordingly, this lifting assembly is unable to engage loads in the top far side position on the carrying vehicle.

Referring specifically to FIGS. 1(*iv*) to 1(*vi*), the truck mounted forklift with a static mast is illustrated engaging a load 11 in a variety of positions on a carrying vehicle 13. In FIG. 1(*iv*) the truck mounted forklift 1 is shown engaging a load 11 located in the bottom far side position of the carrying vehicle. The front wheels 17 of the truck mounted forklift 1 are positioned under the carrying vehicle 13. The static mast 7 is in position on the forklift 1 and the pantograph linkage 5 is fully extended. In FIG. 1(*v*) the truck mounted forklift 1 is shown engaging a load 11 located in the top far side position of the carrying vehicle 13. It can be seen that the static mast 7 and the pantograph linkage 5 extend significantly upwards of the load 11 and may be obstructed by the roof of the trailer (not shown). In FIG. 1(*vi*) the truck mounted forklift 1 is shown attempting to engage a load in the top far side position on the carrying vehicle. It can be seen that the front wheels 17 are not positioned under the carrying vehicle 13. Accordingly, this lifting assembly is unable to engage loads in the top far side position on the carrying vehicle.

Referring specifically to FIGS. 1(*vii*) to 1(*ix*), the truck mounted forklift with a telescopic boom is illustrated engaging a load 11 in a variety of positions on a carrying vehicle 13. In FIG. 1(*vii*) the truck mounted forklift 1 is shown engaging a load 11 located in the bottom far side position of the carrying vehicle. The telescopic boom 9 is positioned forwards on the forklift 1 and is fully extended. In FIG. 1(*viii*) the truck mounted forklift 1 is shown engaging a load 11 located in the top near side position of the carrying vehicle. It can be seen that there are no impediments to the lifting assembly engaging the load 11 in these positions. In FIG. 1(*ix*) the truck mounted forklift is shown attempting to engage a load in the top far side position on the carrying vehicle. It can be seen that the telescopic boom comes into contact with the bottom near side load on the carrying vehicle 13 at the point indicated by circle 19. Accordingly, this lifting assembly is often unable to engage loads in the top far side position on the carrying vehicle. In order to overcome this obstruction, the bottom nearside position would have to be unloaded and reloaded, thus increasing the time taken to unload the top far side position.

Figure 2:
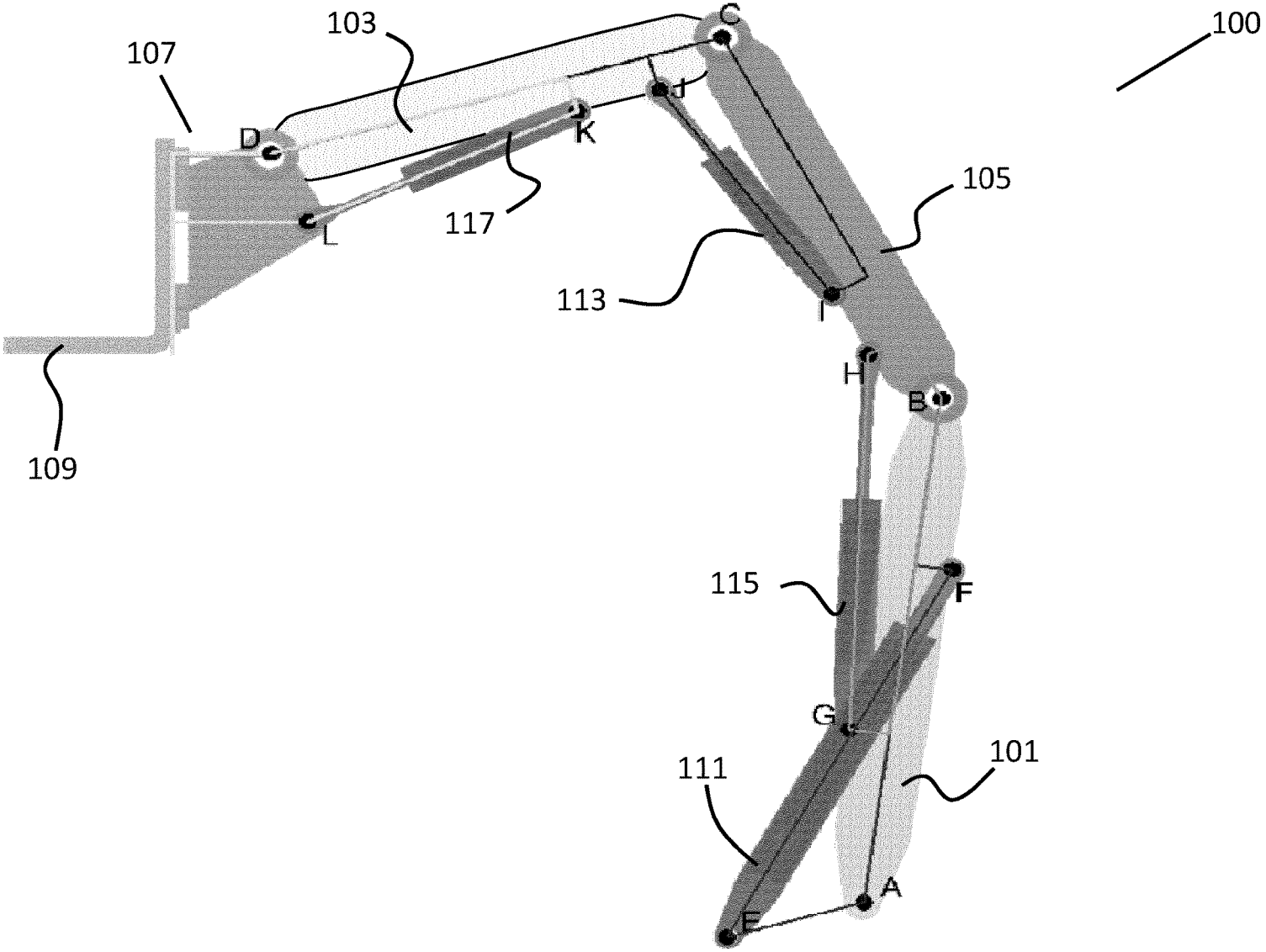
FIG. 2 is a lifting assembly for a truck mounted forklift according to the invention.

Referring to FIG. 2, there is shown a lifting assembly for a truck mounted forklift according to the invention indicated generally by the reference numeral 100. The lifting assembly 100 comprises a linkage, the linkage comprising a first link 101, a second link 103, a third link 105, a fork carriage 107 and a pair of forks 109. There is further provided a plurality of link cylinders 111, 113 and 115 for actuating the links 101, 103 and 105 and a tilt cylinder 117 for actuating the fork carriage 107. Link cylinder 111 is also referred to as a main lift cylinder. The first link 101 is connected at its proximal end to a chassis (not shown) at a pivot joint A. The second link 103 is connected at its distal end to a fork carriage 107 at a pivot joint D. The first link is connected at its distal end to one end of the third link 105 by a pivot joint B and the second link 103 is connected at its proximal end to the other end of the third link 105 by a pivot joint C.

The first link 101 is actuated by the main lift cylinder/link cylinder 111 which is connected at one end to the chassis (not shown) by a pivot joint E and at the other end to the body of the first link 101 by a pivot joint F. The second link 103 is actuated by link cylinder 113 which is connected at one end to the body of the third link cylinder 105 by a pivot joint I and at the other end to the body of the second link cylinder 103 by a pivot joint J. The third link 105 is actuated by link cylinder 115, which is connected at one end to the body of the first link 101 by a pivot joint G and at the other end to the body of the third link by a pivot joint H. The fork carriage 107 is actuated by the tilt cylinder 117 which is connected at one end to the body of the second link 103 by a pivot joint K and at the other end to the fork carriage by a pivot joint L.

Referring to FIGS. 3 to 13 inclusive, there is shown a truck mounted forklift according to the invention indicated generally by the reference numeral 20 with the lifting assembly 100 in a variety of load positions. The truck mounted forklift 20 has a similar construction (with the exception of the lifting assembly) to the truck mounted forklift described in the Applicant's own granted European Patent No. EP1711428, the entire disclosure of which and in particular the disclosure relating to the general physical construction of the forklift truck is incorporated herein by way of reference. The truck mounted forklift 20 comprises a U-shaped chassis having a pair of forwardly projecting side bars bridged by a rear crossbar, a wheel 17 adjacent the forwardmost end of each of the side bars and a rear wheel 21 mounted on the rear cross bar. There is further provided a driver's station mounted to one side of the chassis, a motive power unit mounted on the other side of the chassis, and a lifting assembly (100, 200) mounted on the chassis.

Figure 3:
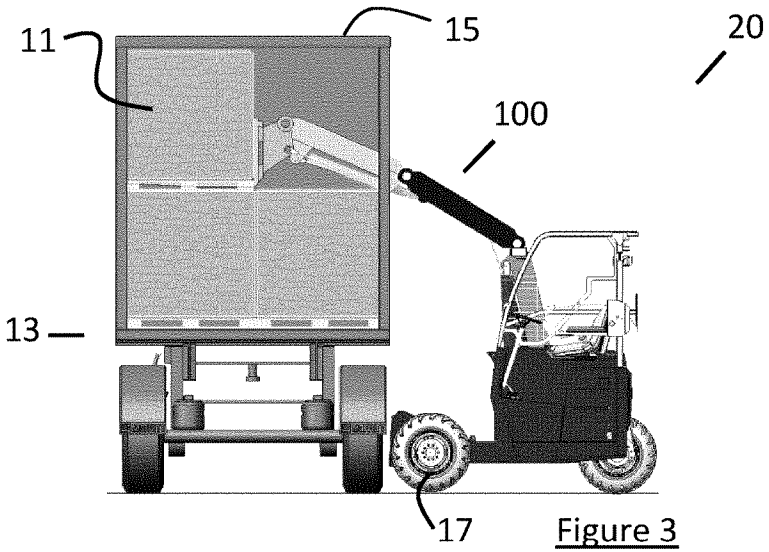

Referring to FIG. 3, there is shown a truck mounted forklift 20 picking up a load 11 from the top far side position of the carrying vehicle 13. It can be seen that the lifting assembly 100 is not obstructed by the load in the bottom near side position or by the roof 15 of the container and that the front wheels 17 do not need to be positioned under the carrying vehicle 13.

Figure 4:
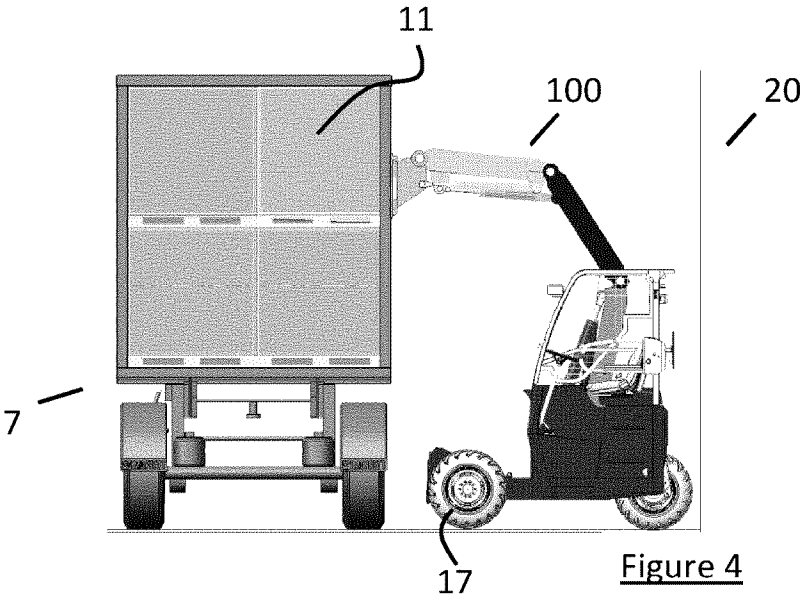
FIGS. 3 to 13 inclusive are side views of a truck mounted forklift according to the invention in a variety of load positions.

Referring to FIG. 4, there is shown a truck mounted forklift 20 picking up a load 11 from the top near side of the carrying vehicle 13. It can be seen that the lifting assembly 100 is not obstructed by the container.

Figure 5:
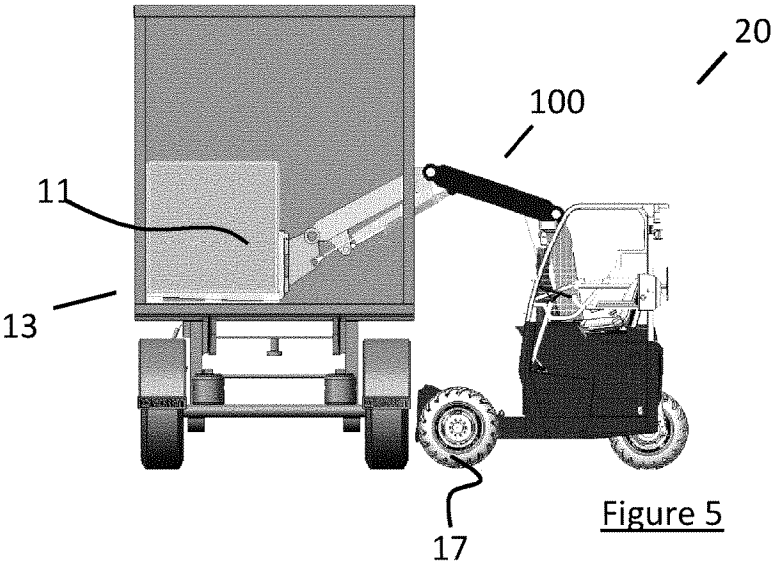

Referring to FIG. 5, there is shown a truck mounted forklift 20 picking up a load 11 from the bottom far side of the carrying vehicle 13. It can be seen that the front wheels 17 do not need to be positioned under the carrying vehicle 13.

Figure 6:
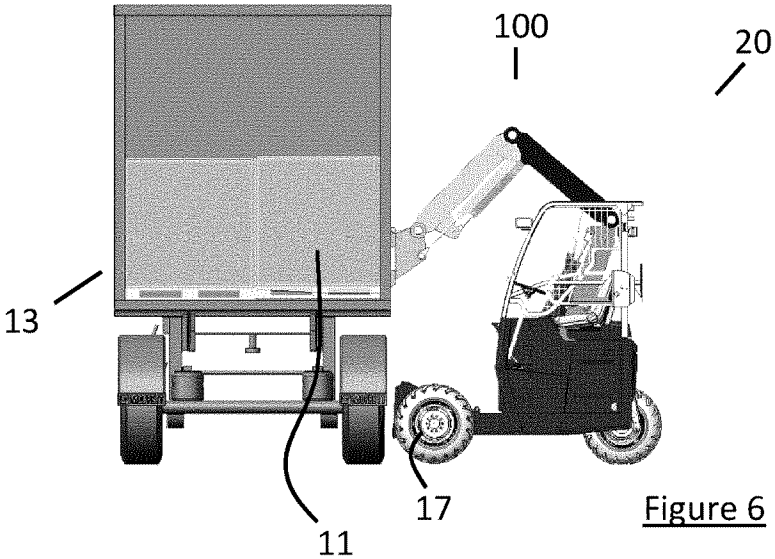

Referring to FIG. 6, there is shown a truck mounted forklift 20 picking up a load 11 from the bottom near side of the carrying vehicle 13.

Figure 7:
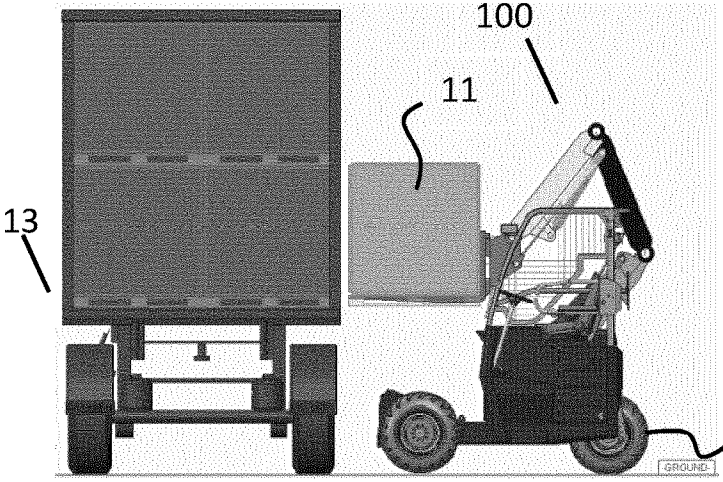

Referring to FIG. 7, there is shown a truck mounted forklift 20 with the lifting assembly 100 in a retracted position having picked up a load 11 from the bottom of the carrying vehicle 13. It can be seen that no part of the lifting assembly 100 extends substantially behind a rear wheel 21 of the truck mounted forklift. This ensures the load overhang and overall truck or trailer length is kept to a minimum.

Figure 8:
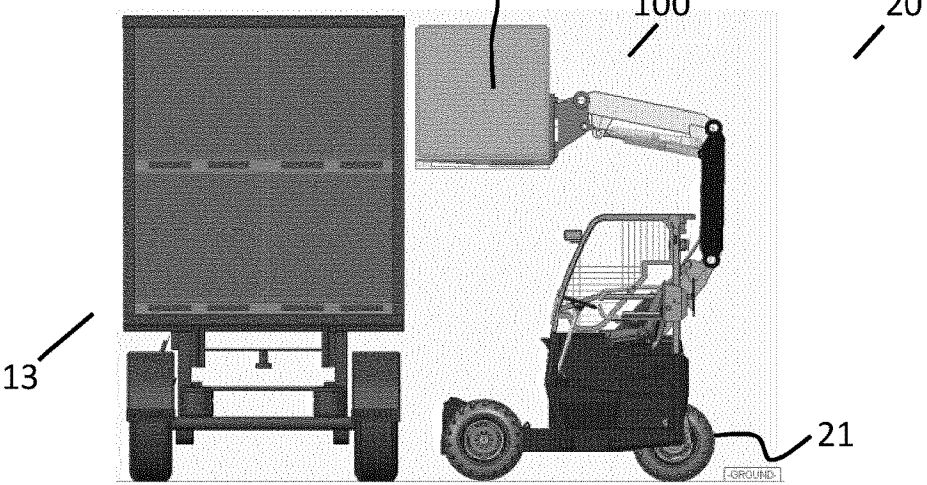

Referring to FIG. 8, there is shown a truck mounted forklift 20 with lifting assembly 100 in a raised, retracted position.

Figure 9:
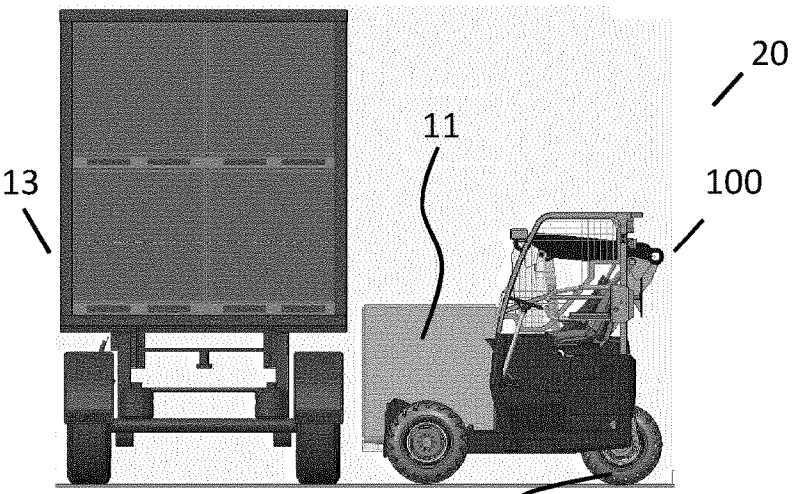

Referring to FIG. 9, there is shown a truck mounted forklift 20 with lifting assembly 100 in a lowered, retracted position having picked up the load 11 from the carrying vehicle 13. This is a stable position for driving. It can be seen that the transition from the retracted positions shown in FIGS. 7 and 8 to the lowered and retracted position shown in FIG. 9 does not require that the linkage 100 extends substantially beyond the rear wheel 21 and does not destabilise the truck mounted forklift 20. It can also be seen that the height of the linkage in the collapsed position does not add to the overall height of the machine.

Figure 10:
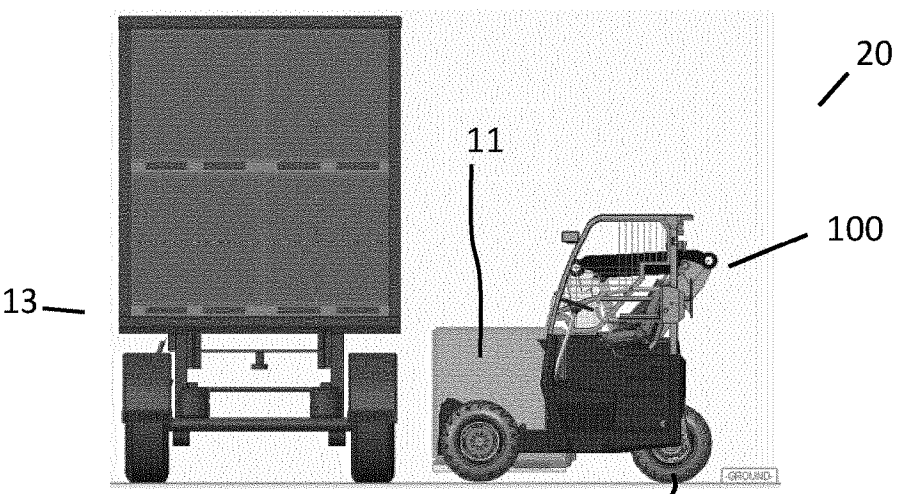

Referring to FIG. 10, there is shown a truck mounted forklift 20 with lifting assembly 100 in an extra lowered and retracted position having picked up the load 11 from the carrying vehicle 13. This extra lowered position is enabled by the u-shaped chassis. This is a particularly stable position for driving, picking up or placing heavy loads. It can be seen that the transition from the retracted positions shown in FIGS. 7 and 8 to the lowered and retracted position shown in FIG. 10 does not require that the linkage 100 extends substantially beyond the rear wheel 21 and does not destabilise the truck mounted forklift 20.

Figure 11:
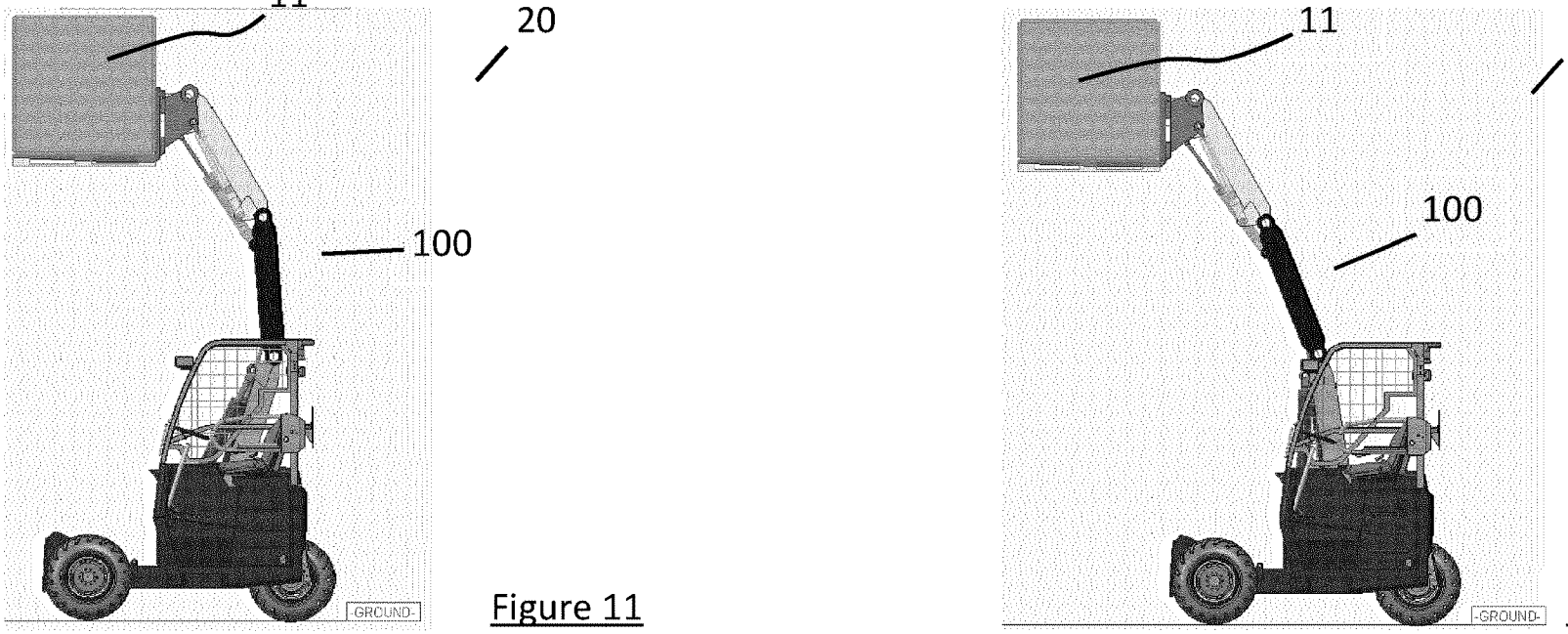

Referring to FIG. 11, there is shown a truck mounted forklift 20 with lifting assembly 100 in a slightly retracted position having picked up the load 11 from the highest point in its reach.

Figure 12:
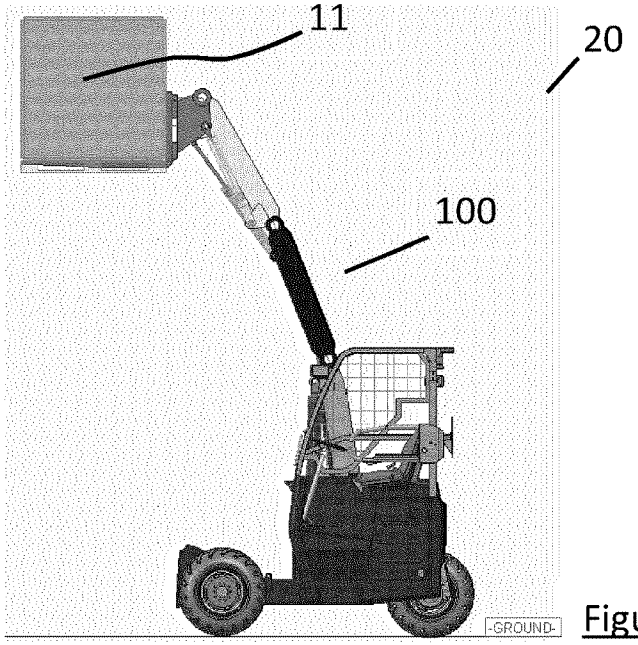

Referring to FIG. 12, there is shown a truck mounted forklift 20 with lifting assembly 100 in position to pick up the load 11 from the highest point in its reach.

Figure 13:
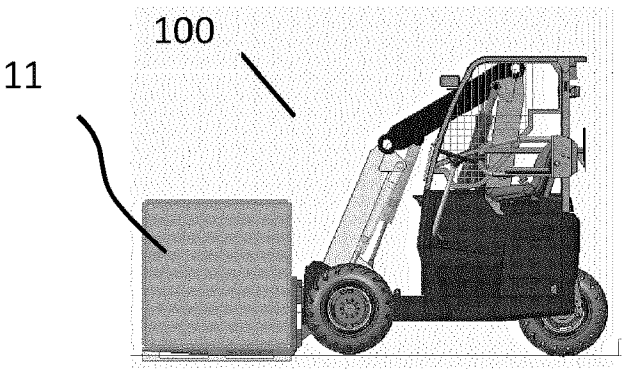

Referring to FIG. 13, there is shown a truck mounted forklift 20 with lifting assembly 100 in position to pick up or put down the load 11 at ground level.

Figure 14:
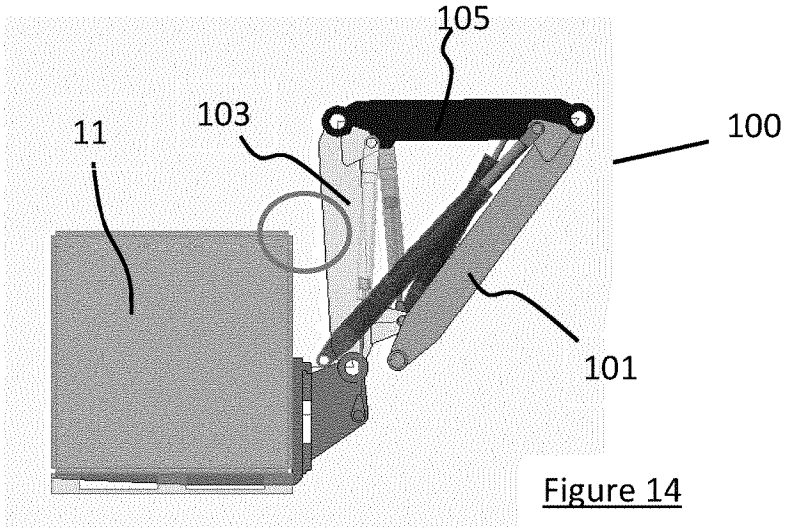
FIG. 14 is a side view of the lifting assembly in a retracted travel position.

Referring to FIG. 14, there is shown the lifting assembly 100 in a retracted position. It can be seen that the second link 103 of the lifting assembly 100 does not touch the load 11.

Figure 15:
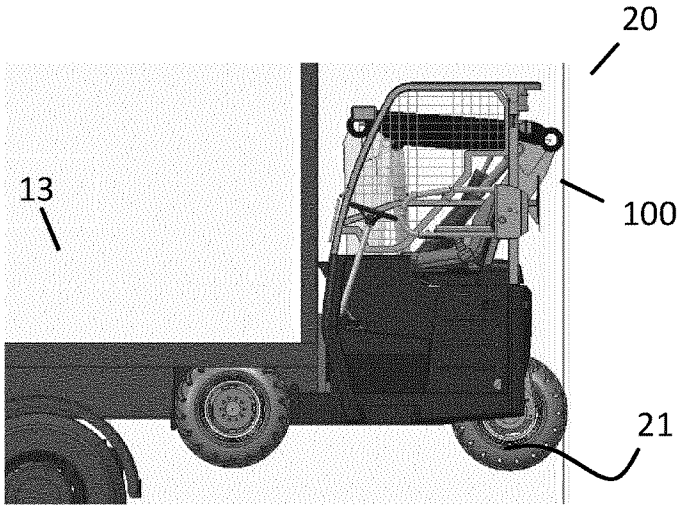
FIG. 15 is a side view of a truck mounted forklift according to the invention mounted on the back of a truck.

Referring to FIG. 15, there is shown a truck mounted forklift 20 with lifting assembly 100 fully retracted for transport. The truck mounted forklift is mounted on the back of the carrying vehicle 13. It can be seen that the lifting assembly 100 does not extend behind the rear wheel 21 unless the rear wheel 21 is rotated to a stowed or turning configuration.

Figure 16:
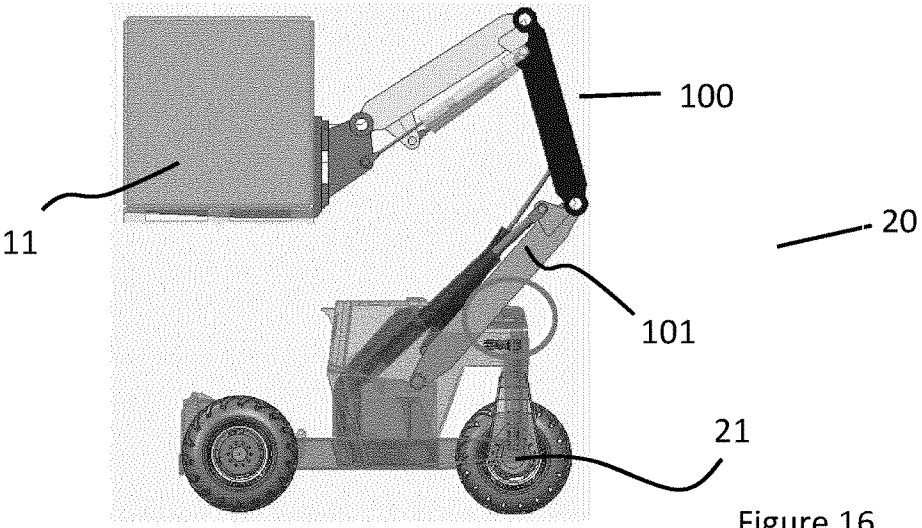
FIG. 16 is a side view of the lifting assembly with the driver's station removed.

Referring to FIG. 16, there is shown a truck mounted forklift 20 with lifting assembly 100 in a retracted configuration. The driver's station has been omitted for clarity. It can be seen that the first link 101 of the lifting assembly 100 does not interfere with the rear steering set-up.

Figure 17:
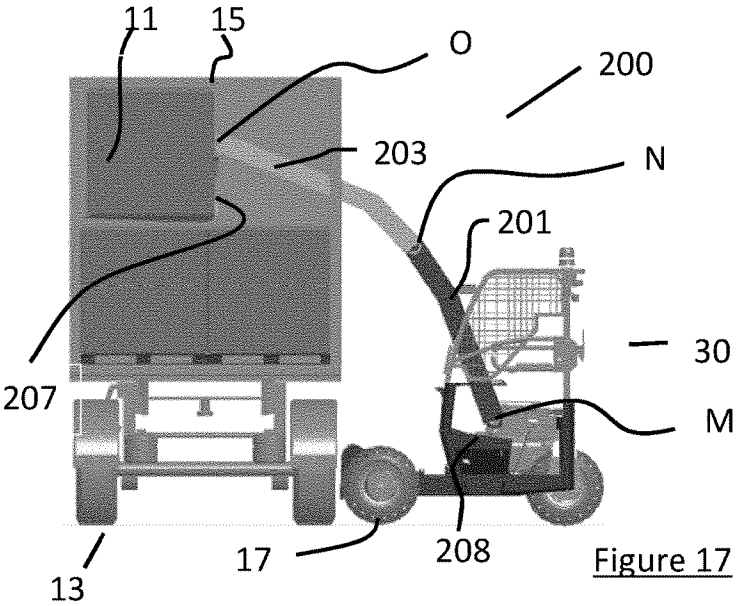

Referring to FIG. 17, there is shown an alternative embodiment of a lifting assembly, indicated generally by the reference numeral 200, for a truck mounted forklift 30 according to the invention, where like parts have been given the same reference numerals as before. The lifting assembly 200 comprises a linkage, the linkage comprising a first link 201, a second link 203, a fork carriage 207 and a pair of forks (not shown). There is further provided a plurality of link cylinders (not shown) for actuating the links 201, 203 and a tilt cylinder (not shown) for actuating the fork carriage 207. The first link 201 is connected at its proximal end to a chassis 208 at a pivot joint M. The second link 203 is connected at its distal end to the fork carriage 207 at a pivot joint O. The first link is connected at its distal end to the proximal end of the second link 203 by a pivot joint N. It can be seen that the first link 201 and the second link, 203, are cranked intermediate their ends. However, a linkage comprising one or two straight links is also envisaged. The truck mounted forklift 30 is shown picking up a load 11 from the top far side position of the carrying vehicle 13. It can be seen that the lifting assembly 200 is not obstructed by the load in the bottom near side position or by the roof 15 of the container and that the front wheels 17 do not need to be positioned under the carrying vehicle 13.

Figure 18:
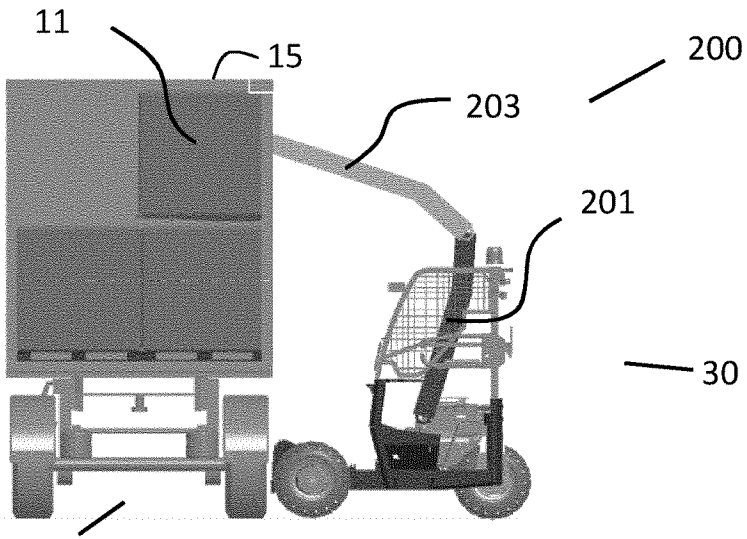

Referring to FIG. 18, there is shown the truck mounted forklift 30 picking up a load 11 from the top near side of the carrying vehicle 13. It can be seen that the lifting assembly 200 is not obstructed by the roof 15 of the container.

Figure 19:
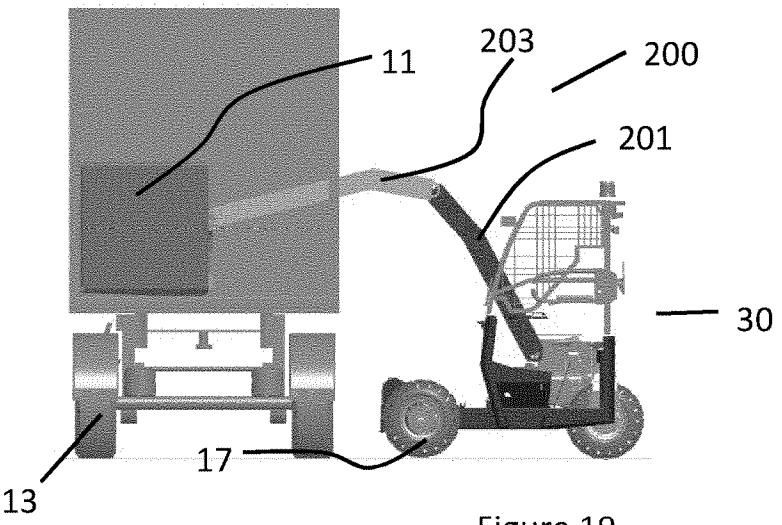

Referring to FIG. 19, there is shown the truck mounted forklift 30 picking up a load 11 from the bottom far side of the carrying vehicle 13. It can be seen that the front wheels 17 do not need to be positioned under the carrying vehicle 13.

Figure 20:
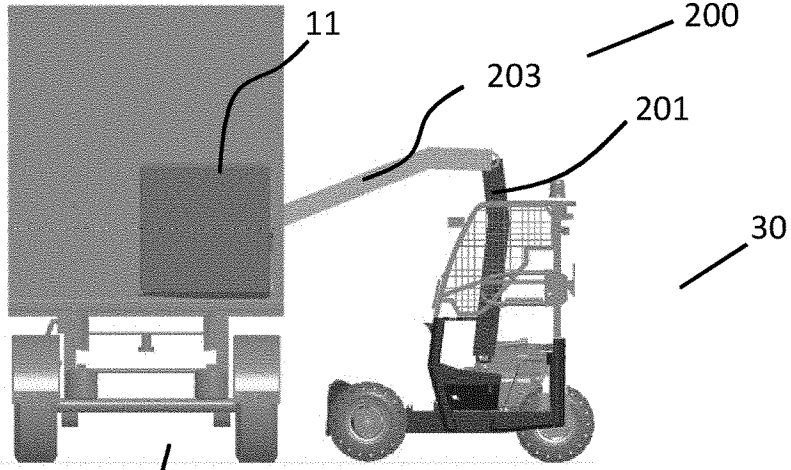

Referring to FIG. 20, there is shown a truck mounted forklift 30 picking up a load 11 from the bottom near side of the carrying vehicle 13.

Referring to FIG. 21, there is shown the truck mounted forklift 30 picking up a load 11 from the ground forward of the front wheels.

Referring to FIG. 22, there is shown the truck mounted forklift 30 in a retracted position after picking up a load 11 from the bottom of the carrying vehicle. In this position the linkage 200 temporarily extends beyond the rear wheel 21.

Referring to FIG. 23, there is shown the truck mounted forklift 30 after picking up a load 11 from the top of the carrying vehicle. In this position the linkage 200 extends beyond the rear wheel 21.

Referring to FIG. 24, there is shown the truck mounted forklift 30 in position for picking up a load 11 from the top near side of a carrying vehicle (not shown).

Figure 25:
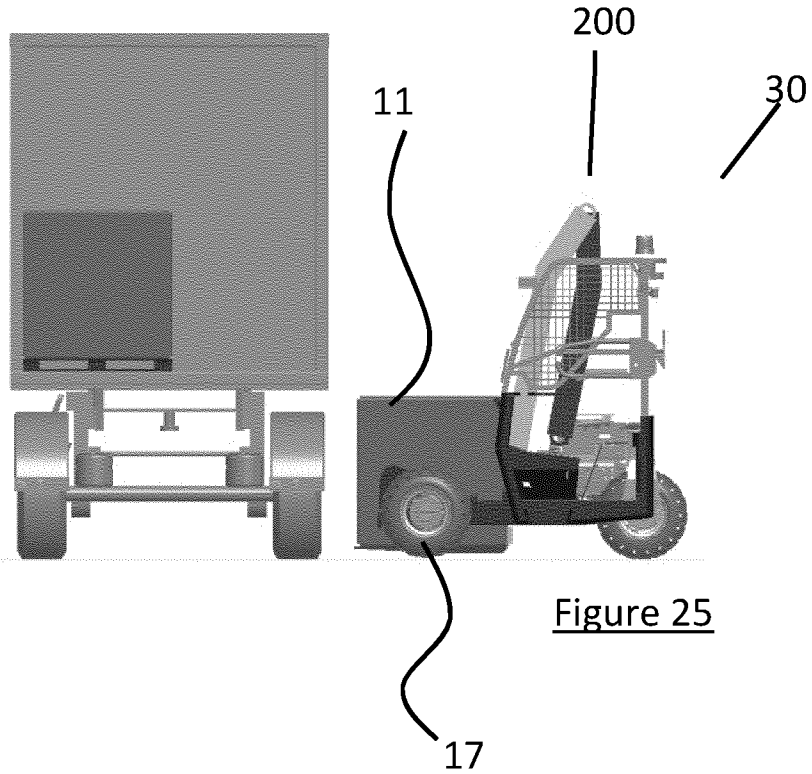

Referring to FIG. 25, there is shown the truck mounted forklift 30 with its forks in a lowered position for picking up a load substantially rearward of the front wheels.

Figure 26:
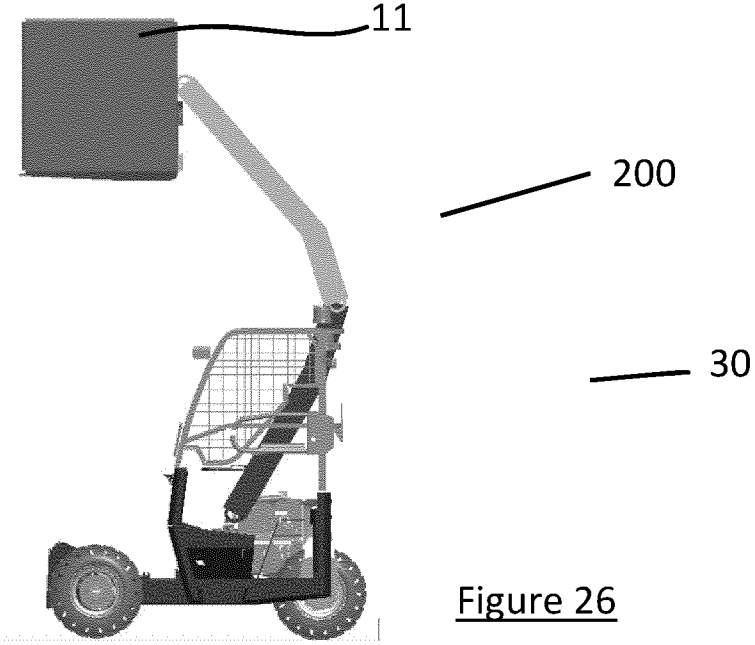

Referring to FIG. 26, there is shown the truck mounted forklift 30 with the lifting assembly 200 in a slightly retracted position after picking up load 11 from the top of the carrying vehicle. In this position the lifting assembly 200 does not extend beyond the rear wheel 21.

Figure 27:
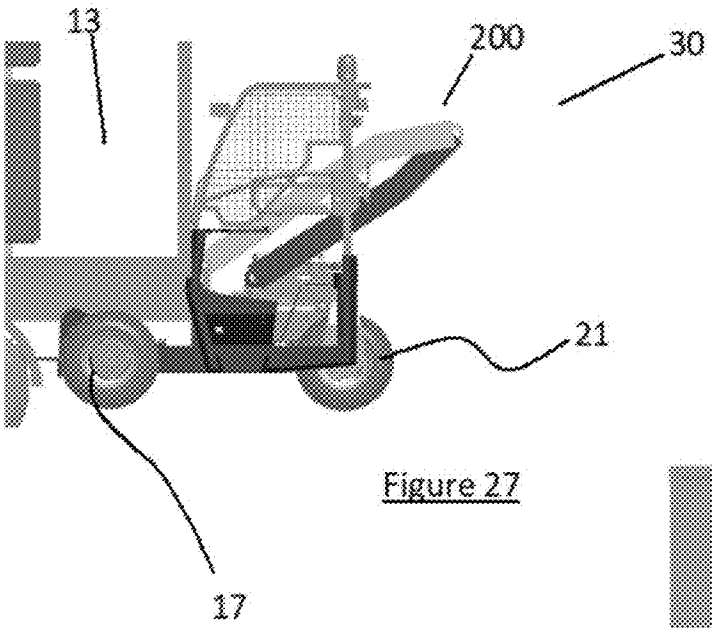

Referring to FIG. 27, there is shown the truck mounted forklift 30 mounted on the rear of the carrying vehicle 13. It can be seen that with this configuration, the linkage 200 extends behind the rear wheel 21 of the truck mounted forklift.

Figure 28:
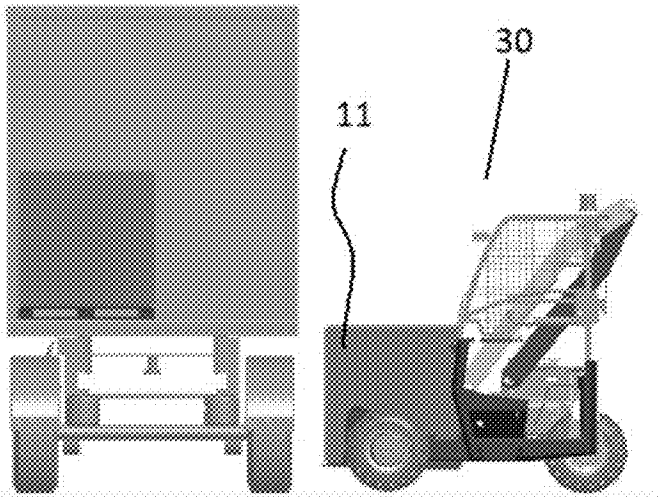

Referring to FIG. 28, there is shown the truck mounted forklift 30 with the linkage 200 in a lowered position for carrying load 11.

In the embodiments described, the linkage comprises two or three links connected together. However, it will be understood that more than three links could be provided.

Furthermore, it will be understood that in each of the positions of the lifting assembly described above, the linkage can move horizontally or vertically from one position to another. There is provided a control system which enables "tip control" in which all the cylinders work together to provide purely vertical or horizontal control of the forks for the driver. It will be understood that the linkage may also tilt the fork carriage through the required forwards and backwards tilt in all positions. This will ensure ease of pick up and placement as well as security of transport.

In the embodiments described one or more single acting rams may be used, or, alternatively, a double-acting ram may be used for each of the link cylinders 111, 113 and 115 and on the tilt cylinder 117.

In this specification the terms "comprise, comprises, comprised and comprising" and the terms "include, includes, included and including" are all deemed totally interchangeable and should be afforded the widest possible interpretation.

The invention is in no way limited to the embodiment hereinbefore described but may be varied in both construction and detail within the scope of the claims.

The invention claimed is:

1. A truck mounted forklift for mounting on the rear of a vehicle, the truck mounted forklift comprising a u-shaped chassis having a pair of forwardly projecting side bars bridged by a rear crossbar, a wheel adjacent the forwardmost end of each of the side bars and a rear wheel mounted on the rear cross bar, a driver's station mounted to one side of the chassis, a motive power unit mounted on the other side of the chassis and a lifting assembly mounted on the chassis characterised in that, the lifting assembly comprises a linkage, the linkage comprising:

an elongate first link connected at its proximal end to the chassis by a pivot joint;

an elongate second link;

an elongate third link connected intermediate the first link and the second link, one end of the third link is connected to the distal end of the first link by a pivot joint, and the other end of the third link is connected to the proximal end of the second link by a pivot joint;

a fork carriage connected to the distal end of the second link by a pivot joint;

a plurality of link cylinders for actuating the links; and a tilt cylinder for actuating the fork carriage; and in which the linkage is configured to permit the first link to pivot rearwardly beyond a substantially vertical orientation with respect to the ground, so that the fork carriage, in a lowered position for picking up a load at a ground level, is rearward of the wheels adjacent the forwardmost end of each of the side bars.

2. The truck mounted forklift as claimed in claim 1 in which one of the link cylinders is connected to the chassis at one of its ends and connected to the first link at the other of its ends.

3. The truck mounted forklift as claimed in claim 1 in which the tilt cylinder is connected at one of its ends to the fork carriage and at the other of its ends to the second link.

4. The truck mounted forklift as claimed in claim 1 in which the first link and the third link are further coupled together by one of the link cylinders; and the second link and the third link are further coupled together by one of the link cylinders.

5. The truck mounted forklift as claimed in claim 1 in which there is provided a control system operable to synchronise the operation of the tilt and link cylinders.

6. The truck mounted forklift as claimed in claim 1 in which each link is actuated using a pair of cylinders.

7. The truck mounted forklift as claimed in claim 1 in which there is provided a pair of tilt cylinders.

8. The truck mounted forklift as claimed in claim 1 whereby the linkage is configured to not extend rearwards beyond the rear wheel of the chassis when fully retracted.

9. The truck mounted forklift as claimed in claim 1 in which the linkage is configured to prevent the second link (103) from pivoting rearwardly beyond a substantially vertical orientation with respect to the ground.

10. The truck mounted forklift as claimed in claim 1 whereby the lifting assembly further comprises a carriage and in which the proximal end of the first link is mounted on the carriage.

11. The truck mounted forklift as claimed in claim 1 in which the first link is cranked intermediate its ends.

12. The truck mounted forklift as claimed in claim 1 in which the second link is cranked intermediate its ends.

13. The truck mounted forklift as claimed in claim 1 in which the third link is cranked intermediate it's ends.

14. The truck mounted forklift as claimed in claim 1 in which the third link is shorter in length than the first link.

15. The truck mounted forklift as claimed in claim 1 in which the third link is shorter in length than the second link.

16. The truck mounted forklift as claimed in claim 1 in which the lifting assembly is mounted centrally across the truck mounted forklift substantially in line with the longitudinal axis of the truck mounted forklift.

17. A truck mounted forklift for mounting on the rear of a vehicle, the truck mounted forklift comprising a u-shaped chassis having a pair of forwardly projecting side bars bridged by a rear crossbar, a wheel adjacent the forwardmost end of each of the side bars and a rear wheel mounted on the rear cross bar, a driver's station mounted to one side of the chassis, a motive power unit mounted on the other side of the chassis and a lifting assembly mounted on the chassis characterised in that, the lifting assembly comprises a linkage, the linkage comprising:

an elongate first link connected at its proximal end to the chassis by a pivot joint;

an elongate second link;

an elongate third link connected intermediate the first link and the second link, one end of the third link is connected to the distal end of the first link by a pivot joint, and the other end of the third link is connected to the proximal end of the second link by a pivot joint;

a fork carriage connected to the distal end of the second link by a pivot joint;

a plurality of link cylinders for actuating the links;

a tilt cylinder for actuating the fork carriage;

whereby the linkage is configured to not extend rearwards beyond the rear wheel of the chassis when fully retracted; and in which the linkage is configured to permit the first link to pivot rearwardly beyond a substantially vertical orientation with respect to the ground, so that the fork carriage, in a lowered position for picking up a load at a ground level, is rearward of the wheels adjacent the forwardmost end of each of the side bars.

18. The truck mounted forklift as claimed in claim 17 in which the first link is cranked intermediate its ends.

19. The truck mounted forklift as claimed in claim 17 in which the second link is cranked intermediate its ends.

20. A truck mounted forklift for mounting on the rear of a vehicle, the truck mounted forklift comprising a u-shaped chassis having a pair of forwardly projecting side bars bridged by a rear crossbar, a wheel adjacent the forwardmost end of each of the side bars and a rear wheel mounted on the rear cross bar, a driver's station mounted to one side of the chassis, a motive power unit mounted on the other side of the chassis and a lifting assembly mounted on the chassis characterised in that, the lifting assembly comprises a linkage, the linkage comprising:

an elongate first link connected at its proximal end to the chassis by a pivot joint;

an elongate second link;

an elongate third link connected intermediate the first link and the second link, one end of the third link is connected to the distal end of the first link by a pivot joint, and the other end of the third link is connected to the proximal end of the second link by a pivot joint;

a fork carriage connected to the distal end of the second link by a pivot joint;

a plurality of link cylinders for actuating the links;

a tilt cylinder for actuating the fork carriage;

whereby the lifting assembly further comprises a carriage; and in which the proximal end of the first link is mounted on the carriage; and in which the linkage is configured to permit the first link to pivot rearwardly beyond a substantially vertical orientation with respect to the ground, so that the fork carriage, in a lowered position for picking up a load at a ground level, is rearward of the wheels adjacent the forwardmost end of each of the side bars.

* * * * *